US008240828B2

(12) United States Patent
Sharan et al.

(10) Patent No.: US 8,240,828 B2
(45) Date of Patent: Aug. 14, 2012

(54) FLUID EJECTION CARTRIDGE AND METHOD

(75) Inventors: Alok Sharan, Lake Oswego, OR (US); Manishi Giri, Corvallis, OR (US); Siddhartha Bhowmik, Salem, OR (US); Richard W Seaver, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 269 days.

(21) Appl. No.: 12/747,629

(22) PCT Filed: Jan. 9, 2008

(86) PCT No.: PCT/US2008/050608

§ 371 (c)(1), (2), (4) Date: Jun. 11, 2010

(87) PCT Pub. No.: WO2009/088510

PCT Pub. Date: Jul. 16, 2009

(65) Prior Publication Data

US 2010/0271445 A1 Oct. 28, 2010

(51) Int. Cl.
*B41J 2/175* (2006.01)

(52) U.S. Cl. ..... 347/86

(58) Field of Classification Search ..... 347/86, 347/87, 85, 92, 63, 65, 70
See application file for complete search history.

(56) References Cited

U.S. PATENT DOCUMENTS

| | | | | |
|---|---|---|---|---|
| 5,751,324 | A | 5/1998 | Brandon et al. | |
| 6,243,112 | B1 | 6/2001 | Kuhman et al. | |
| 6,679,587 | B2 | 1/2004 | Chen et al. | |
| 7,001,010 | B2 | 2/2006 | Koyama et al. | |
| 7,063,413 | B2 | 6/2006 | Gibson et al. | |
| 8,061,810 | B2 * | 11/2011 | Hoisington et al. | 347/65 |
| 8,147,040 | B2 * | 4/2012 | Menzel et al. | 347/70 |
| 2005/0110829 | A1 | 5/2005 | Keenan et al. | |
| 2005/0219327 | A1 | 10/2005 | Clarke et al. | |
| 2006/0093787 | A1 | 5/2006 | Chen et al. | |
| 2007/0263038 | A1 | 11/2007 | Bibl | |
| 2008/0003779 | A1 | 1/2008 | Sawyer | |

FOREIGN PATENT DOCUMENTS

| | | |
|---|---|---|
| JP | 06183011 | 7/1994 |
| JP | 2002-273882 | 9/2002 |
| JP | 2002331659 | 11/2002 |
| JP | 2007-531645 | 11/2007 |
| WO | 2006047052 | 5/2006 |

* cited by examiner

*Primary Examiner* — Kristal Feggins

(57) ABSTRACT

A fluid ejection cartridge includes a body, having fluid passageways at a first spacing, a die, having fluid passage-ways at a second closer spacing, and an interposer, bonded to the body at a first surface and plasma bonded to the die at a second surface. The interposer includes fluid passageways between the first and second surfaces, which are substantially aligned with the respective passageways of the body and the die.

20 Claims, 11 Drawing Sheets

FLUID EJECTION CARTRIDGE AND METHOD

BACKGROUND

This disclosure relates generally to fluid ejection devices, also referred to herein as "fluid jet" devices, such as ink jet cartridges and the like. Fluid jet devices generally include a silicon die that is bonded to a cartridge body. The die can include a semiconductor substrate, which includes an array of nozzles and circuitry for controlling the nozzles. The nozzles eject individual droplets of fluid onto a substrate in response to commands that are sent from a controller system. For color printing, for example, a fluid jet cartridge can include multiple dies that each eject a different color of ink. Alternatively, a single die can include multiple rows of nozzles, each row of nozzles ejecting a different color of ink. Similarly, a fluid jet cartridge can include multiple dies in a fixed position to cover an entire page width in a single pass.

In order to reduce the width of fluid jet dies having multiple rows of nozzles, it can be desirable to place the rows of nozzles closer together. Reducing the width of a fluid jet die is desirable in part from a cost standpoint. High quality silicon semiconductor wafers are costly. Where the die is narrower, a larger number of dies can be fabricated on a single silicon wafer. To this end, fluid jet dies with nozzle rows at a closer spacing or pitch have been developed. The die includes fluid passageways or slots that communicate with the rows of nozzles. The cartridge body also includes fluid passageways or channels that communicate with the passageways of the die, to deliver fluid thereto. Where the nozzle rows are closer together, the fluid passageways in the die will also be closer together, which will require the channels in the cartridge body to be closer together.

As the width of the die decreases, certain design challenges arise. One of these challenges relates to the method of attachment of the die to the cartridge body. The cartridge body is often of polymer material, while the cartridge die can be of high quality electronics grade silicon. Attachment of the silicon die to the polymer cartridge body is typically done with an organic adhesive. However, very small spacing of the fluid channels in the cartridge body can cause adhesive to be squeezed into the fluid channels. This adhesive can block the channels, and lead to poor performance or failure of the cartridge.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1A:
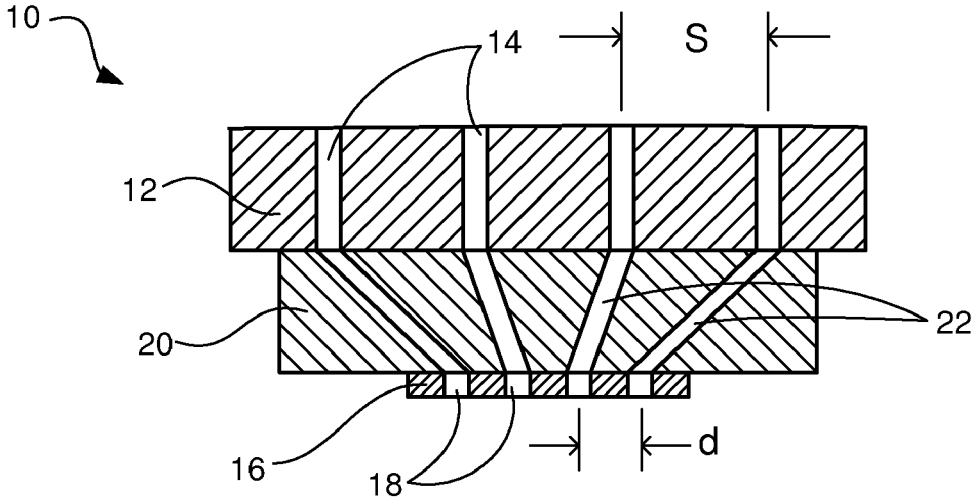
FIG. 1A is a cross-sectional view of one embodiment of a cartridge having a plasma-bonded silicon interposer between the die and the cartridge body.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

As noted above, fluid jet cartridges are being produced with smaller and smaller spacing between arrays of nozzles, and thus with smaller and smaller spacing or pitch between fluid channels and passageways in the fluid jet die that serve the nozzle arrays. As used herein, the terms "slot pitch" and "spacing" are used interchangeably to refer to the center-to-center spacing between adjacent fluid passageways (e.g. elongate channels) or groups of passageways (e.g. groups of openings arranged generally in a line and communicating with a common fluid source) in a body, such as a cartridge body or fluid jet die. A smaller pitch between fluid channels can present some difficulties when the fluid jet die is attached to the cartridge body with adhesive. Very small pitch of the fluid channels in the cartridge body can cause adhesive to be squeezed into the fluid channels when the die is attached to the cartridge body. In particular, the inventors have found that adhesive bonding does not work well for slot pitches of less than about 800 microns. A smaller slot pitch tends to cause adhesive to be squeezed into the fluidic channels, and can block the channels, and lead to poor performance or failure of the cartridge.

Figure 1B:
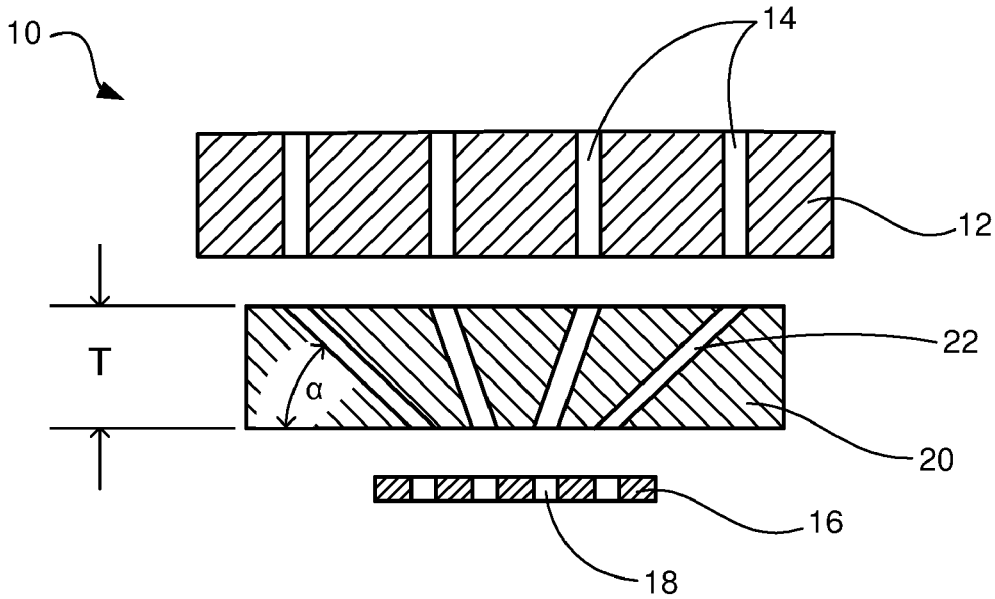
FIG. 1B is an exploded cross-sectional view of the embodiment of FIG. 1A.

Advantageously, the inventors have created a fluid jet cartridge configuration that allows a fluid jet die having very closely spaced fluid channels to be attached to a cartridge body with a much wider fluid channel spacing, and which avoids some undesirable issues associated with adhesive bonding of a silicon die to a polymer cartridge body. As used herein, the term "fluid" is intended to refer to any kind of liquid, such as ink, food products, chemicals, pharmaceutical compounds, fuels, etc. The term "fluid jet" is intended to refer to any drop-on-demand fluid ejection system. Shown in FIGS. 1A-B is a partial cross-sectional view of one embodiment of a fluid jet cartridge configured according to the present disclosure. The cartridge is shown assembled in FIG. 1A, and exploded in FIG. 1B.

This cartridge 10 generally comprises a cartridge body 12 having fluid passageways or channels 14 at a first slot pitch S (measured center-to-center), and a die 16 having fluid passageways or channels 18 at a second smaller slot pitch d. A silicon interposer 20 is disposed between the die and the cartridge body, and includes a plurality of fanned-out passageways 22 that interconnect the closely spaced fluid channels 18 of the fluid jet die with the more widely spaced channels 14 of the cartridge body. The silicon interposer enables the use of a fluid jet die with very small slot pitches, without requiring the same small slot pitch in the cartridge body. The slot pitch d in the fluid jet die can vary from about 400 microns to about 1000 microns, while the slot pitch in the cartridge body is usually about 1000 microns or more.

It will be appreciated that the difference between the pitch d of the fluid openings 18 in the fluid jet die 16 and the pitch S of the fluid openings 14 in the cartridge body 12 will be a function of the thickness T of the interposer 20 and the angle $\alpha$ of the fluid passageways 22 in the interposer. For a given angle, a thicker interposer will provide a larger relative spacing jump. Likewise, for a given interposer thickness, a steeper angle (measured from the vertical) will provide a greater spacing difference. The thickness of the silicon interposer can vary. The inventors believe that a silicon interposer having a thickness of from about 500 microns to about 2000 microns can be configured in accordance with the principles outlined herein. However, interposers with thicknesses outside this range can also be used. Some common silicon fabrication tools can be used with substrates having a thickness of up to about 1000 microns, but thicker substrates can be used with other suitable tools. Using a silicon interposer having a thickness of 1000 microns, and a maximum angle of 45° for the fluid passageways in the interposer, a slot pitch reduction of from about 1000 microns to about 400 microns is possible. The silicon interposer thus enables a more radical slot pitch reduction in fluid jet dies, and thus allows smaller dies to be used with a given cartridge body size. Smaller fluid jet dies can provide a cost savings for production of cartridges, which can be quite significant in some cases, especially for page-wide printing arrays having several fluid jet dies on a single print bar. Cost savings are also significant for scanning type print heads because of the larger volume of such print heads that are manufactured and sold.

Because of the larger pitch of the slots in the cartridge body and the corresponding slots on the adjacent side of the interposer, the silicon interposer can be adhesively bonded to the cartridge body on one side, thus avoiding the possibility of adhesive squeezing into the fluid passageways. Because the interposer and the fluid jet die are both of the same type of material (silicon) these two structures can be plasma bonded together, without the need for adhesive or any other substance to form a strong bond. Plasma bonding is effective because the silicon interposer and the silicon fluid jet die have a native silicon oxide layer on their surface.

Prior to plasma bonding, it is desirable that the silicon surfaces be polished to reduce their surface roughness. This can be done using a chemical-mechanical polishing (CMP) process, which is well known in the art. Plasma bonding of the two silicon substrates can be done in a three part process. First, the native silicon oxide surfaces can be exposed to a nitrogen plasma, which activates the oxide layer—that is, creates active $Si^+$ bonding sites in the molecules on the surface of the silicon oxide by knocking off oxygen atoms. The activated surface can then be exposed to a water plasma, which hydrolyzes the $Si^+$ sites to produce silanol (SiOH) on the surface. In the third step, the surface can be cleaned by exposure to an oxygen plasma. It is to be understood that this is only one example of a process that can be used to plasma treat and bond silicon wafers. Other processes can be used to achieve similar results. For example, wafers can be treated with an argon plasma rather than nitrogen, and then physically dipped into water for hydration. Other variations can also be used.

Following the plasma treatment steps, when the treated surfaces are brought together, the surfaces naturally adhere to each other because of Van der Waal forces. Over time, and depending upon temperature, these relatively weak Van der Waal forces will be replaced by strong covalent bonds as the following reaction takes place between the silanol species:

$$SiOH+SiOH \rightarrow SiOSi+H_2O \quad (1)$$

In order to speed this reaction, the plasma treatment step can be followed by an annealing step, in which the attached silicon substrates are heated in an oven for a length of time. Those of skill in the art will appreciate that the exact annealing temperature and time can vary, with a longer time involved where the temperature is lower, and vice versa. In one embodiment the annealing process involves heating the bonded die assembly to about 120° C. for 2 hours, though the exact process conditions for annealing can vary, and can be determined through experimentation. Those of skill in the art will recognize that annealing can be accomplished with various combinations of time and temperature. As a result of this plasma treatment and annealing process, a very strong bond is formed at the molecular level without the need for adhesive. Indeed, the plasma activated bond between the two silicon layers is believed to be stronger than a plasma activated bond between silicon and glass. The use of plasma bonding avoids the problem of adhesive squeezing into fluid passageways where the slot spacing is small.

In addition to allowing plasma bonding, the use of silicon for the interposer has other advantages, too. For example, silicon can be easily machined by a number of methods, (e.g. by sawing, dry etching, laser etching), and silicon shows better resistance to certain fluids than some glass materials. Additionally, silicon can be cost effective because the interposer need not be of electronic grade silicon, allowing a lower grade of silicon to be used for the interposer. Silicon also provides certain thermal benefits, discussed in more detail below.

Figure 2:
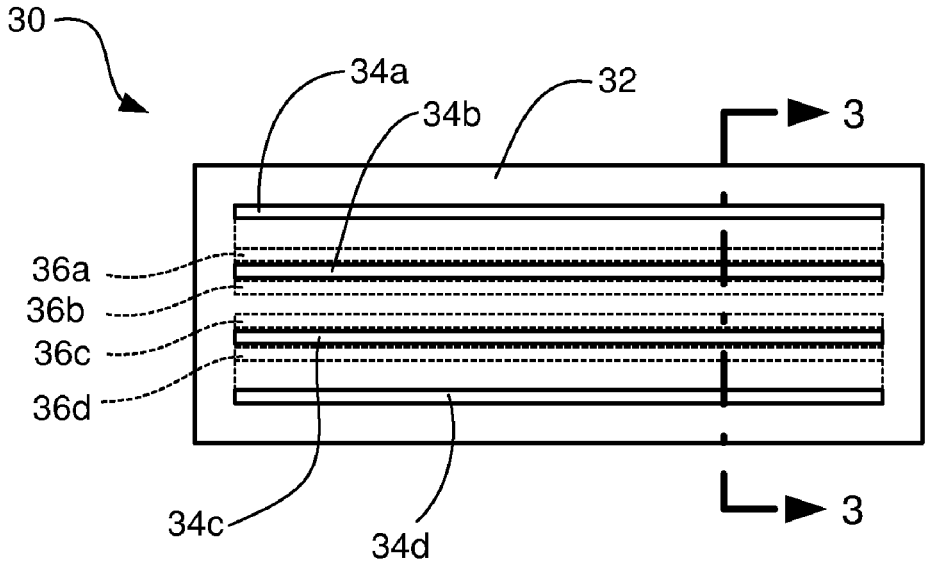
FIG. 2 is a plan view of one embodiment of a silicon interposer having elongate fluid slots.

A plan view of one embodiment of a silicon interposer 30 is provided in FIG. 2. This view shows the top surface 32 of the interposer, with four relatively widely spaced elongate fluid channels, labeled 34*a-d*, that are configured to align with the fluid channels in a cartridge body (not shown in FIG. 2). Unless noted otherwise, the term "top" is used herein to refer to the surface of the interposer that mates with the cartridge body, and the term "bottom" is used to refer to the surface of the interposer that mates with the fluid jet die. Similarly, the surface of the die that mates with the interposer is referred to as the "top" of the fluid jet die, and the surface of the cartridge body that mates with the interposer is referred to as the "bottom" of the cartridge body. The top surface of the interposer can be adhesively bonded to the cartridge body. The fluid channels have a fanned-out configuration, as in the embodiment shown in FIGS. 1A-B. In the plan view of FIG. 2 the lower opening 36*a-d* of each channel is shown in dashed lines, where it can be seen that each channel is angled toward the longitudinal center of the interposer as one moves toward the bottom surface of this layer.

Figure 3:
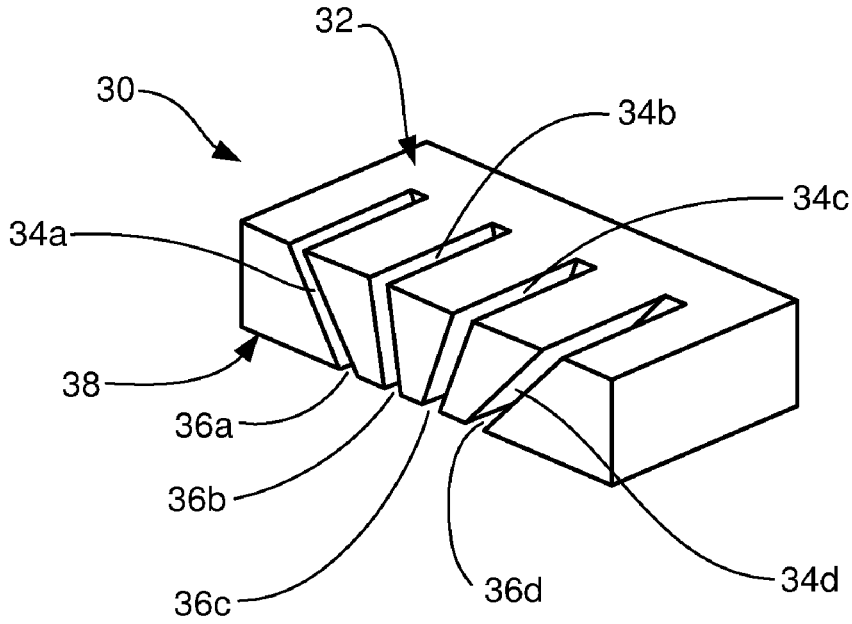
FIG. 3 is a partial cross-sectional perspective view of the silicon interposer of FIG. 2.

A partial cross-sectional view of this interposer 30 is shown in FIG. 3. Here it can be seen that the longitudinal slots 34 extend from the top surface 32 to the bottom surface 38 of the interposer substrate, and have an angled configuration, so that the pitch of the slots is greater at the top surface than at the bottom surface. It is to be understood that, while the slots are shown in the figures as having substantially flat side surfaces and square ends, this appearance is for simplicity in illustration. The slots can have a different shape and appearance, depending upon the method of fabrication. For example, the slots can have a more rounded end shape, and can have rougher or slightly irregular interior surfaces. The exact shape, regularity, and surface finish of the slots can vary, so long as the slots are capable of transporting fluid from the cartridge body to the fluid jet die in the manner discussed herein.

Figure 4:
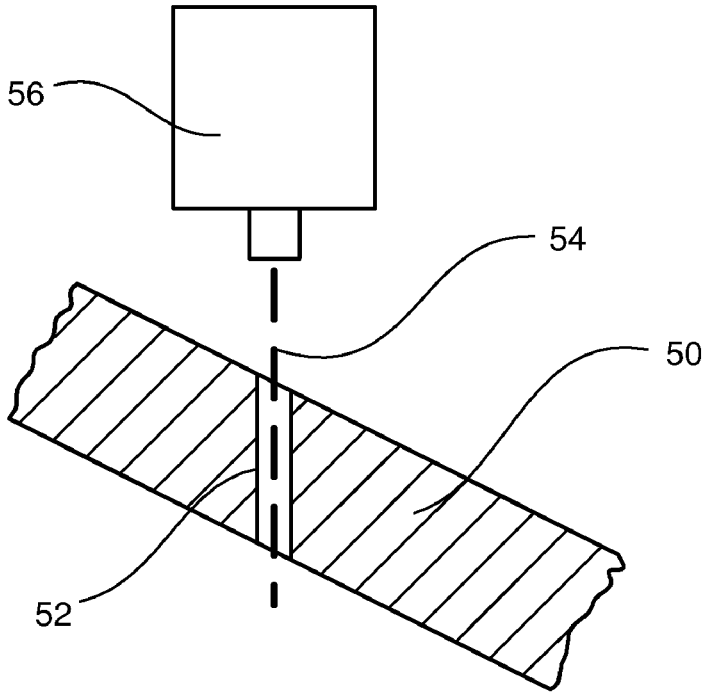
FIG. 4 is a cross-sectional view of one embodiment of a silicon interposer having an angled channel cut with a laser.
Figure 5:
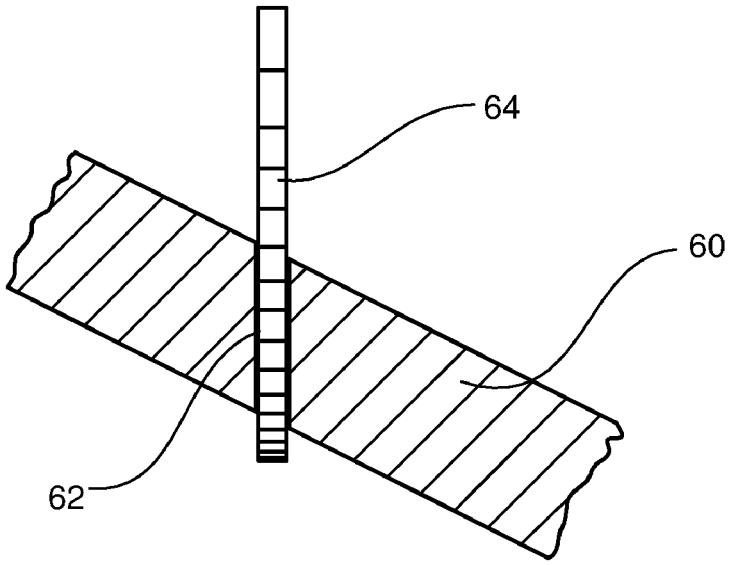
FIG. 5 is a cross-sectional view of one embodiment of a silicon interposer having an angled channel cut with a saw.

The shape, regularity and surface finish of the fluid slots in the interposer depend in part upon the method of fabricating the slots in the silicon interposer. Many methods can be used. Two methods for creating elongate fanned out slots in the interposer are illustrated in FIGS. 4 and 5. Shown in FIG. 4 is a cross-sectional view of one embodiment of a silicon interposer substrate 50 having an angled channel 52 that is being cut with a light beam 54 from a laser device 56. The angle can be produced by tilting the substrate as shown, or the laser device can be tilted with respect to the interposer substrate. Laser ablation of slots is possible if the wafer is tilted at various angles on the holder. Suitable angles can be selected based upon the desired separation of slots and the substrate thickness. For example on a 675 micron thick wafer, the stage could be tilted at 20, 10, 0 −10 and −20 degrees to give 4 divergent slots with additional pitch of about 117 microns. It is to be understood that other angular tilt ranges can be selected. It is believed that slot angles of up to 45° both sides of vertical can be used. As suggested by the figures, the slots can be positioned at differing angles that are substantially uniformly spaced across the total angular range. Thus, if four slots are provided and the maximum angle for the outer slots is 45° from the vertical, the inner slots will each have an angle of about 28.5° relative to the vertical to align with upper and lower slots that are at a uniform spacing. Laser ablation of a silicon substrate can be done using either an infrared (IR) or ultra-violet (UV) laser, and slotting can be further enhanced with the use of an assist medium, such as gas or water.

Another relatively simple method for producing the fluid channels in the interposer is to saw cut a series of angled channels. Shown in FIG. 5 is a cross-sectional view of one embodiment of a silicon interposer substrate 60 having an angled channel 62 that is being cut with a saw blade 64. The desired angle can be provided by tilting the substrate as shown, or by tilting the saw. Saw blades that can be used for this application are commercially available, and can be as thin as 40 microns, allowing the creation of suitably narrow slots.

Figure 6A:
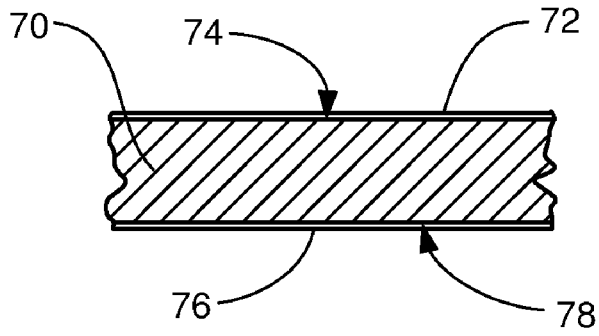
FIG. 6A is a partial cross-sectional view of one embodiment of a silicon interposer substrate before formation of the fanned-out fluid passageways.

Other fabrication techniques can also be used to create the channels in the silicon interposer, such as dry and wet etching techniques. For example, a hard mask can be used to take advantage of self alignment features to create trenches that provide the desired angular deviation. Shown in FIG. 6A is a partial cross-sectional view of one embodiment of a silicon interposer substrate 70 before formation of any fluid passageways. The substrate includes a hard mask 72 on its top surface 74 and another hard mask 76 on its bottom surface 78. The masks can outline the respective locations for the fluid passageways on each surface.

Figure 6B:
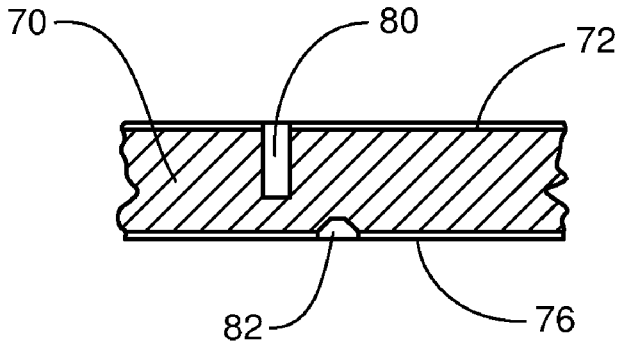
FIG. 6B is a partial cross-sectional view of the silicon interposer of FIG. 6A after initial laser and wet etching.

Following application of the hard masks 72, 76, the fluid channels can then be etched by various methods, such as laser dry and wet etching. As shown in FIG. 6B, an upper portion 80 of a fluid channel can be created by laser etching a partial depth channel in the silicon substrate 70. A lower portion 82 of the same fluid channel can be created by dry etching or laser etching, followed by wet etching. Once these initial channels are created, a wet etch process follows, after which, lateral etching of the sidewalls allows the two fluidic channels to meet. Self-alignment is ensured by the hard-mask layers. After the completion of these steps, the completed channel 84 can be seen in FIG. 6C.

Because of the nature of various etching processes, the completed channel 84 is likely to have some curvature and some undulation of surfaces. However, these sorts of slight geometric irregularities can be tolerated to some extent. Since air bubbles in a fluid jet die can block passageways and affect print quality, fluid jet printers typically include a standpipe (not shown) that is in fluid communication with the fluid jet die. The standpipe is positioned to draw air bubbles away from the fluid jet die. If the fluid channels in the interposer are fabricated so that there is a substantially clear line of sight from the back side of the interposer to the backside of the trench on the silicon die (i.e. no extreme bends or undulations in the channels), then bubbles generated in the firing region of the die will naturally float upward from the die and can be purged in the standpipe. The interposer can thus be designed to promote good air management in the printer.

Figure 6C:
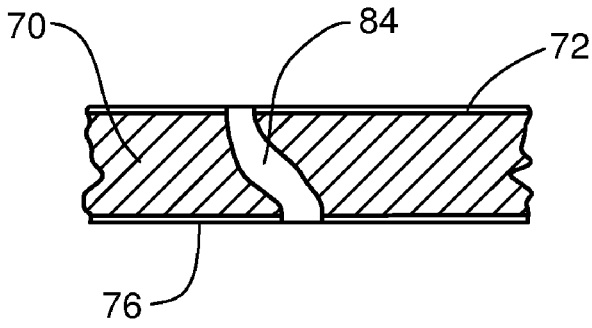
FIG. 6C is a partial cross-sectional view of the silicon interposer of FIG. 6B after final etching of a fluid passageway.

While the hard mask and etching technique illustrated in FIGS. 6A-C presents some limitations, such as limitations in wet etch time, it can be used to provide a suitable silicon interposer for use as described herein. Depending on the depth of etching and the thickness of the silicon interposer, a silicon interposer can be produced that provides a significant pitch change in the fluid channels between the fluid jet die and the cartridge body.

Figure 7:
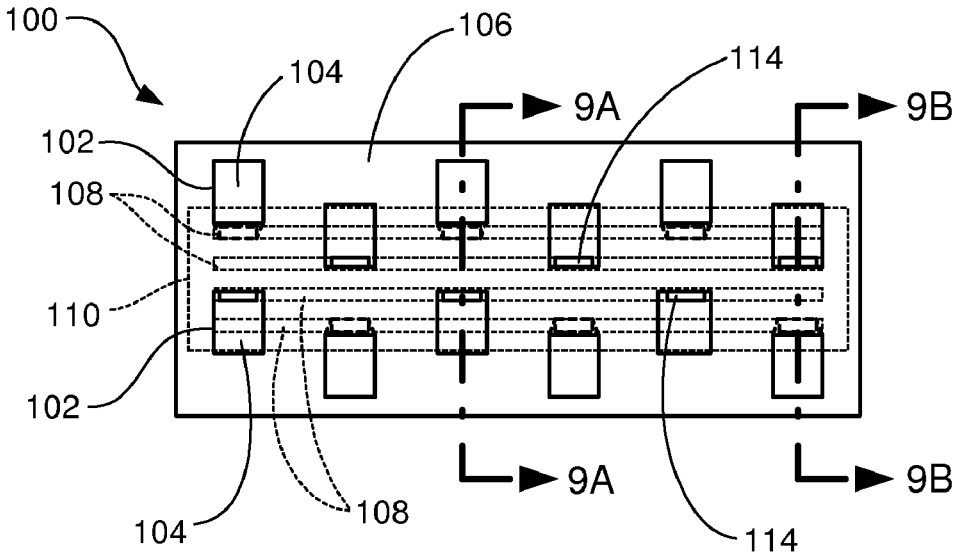
FIG. 7 is a plan view of the top surface of one embodiment of a silicon interposer having etched holes designed to align with the fluid channels of the cartridge body.

Rather than elongate slots or channels, the fluid passageways in the silicon interposer can have other shapes or configurations, such as holes. Shown in FIG. 7 is a plan view of another embodiment of a silicon interposer 100 showing the top openings 102 of etched holes 104 that are at relatively widely spaced locations in the top surface 106 of the silicon interposer substrate. An outline of the corresponding fluid jet die 108 and its relatively closely spaced elongate passageways 110 is shown in dashed lines. The top surface 106 shown in FIG. 7 is the surface that can be adhesively bonded to the cartridge body (not shown in FIG. 7). The top openings 102 are positioned to align with fluid passageways in the cartridge body, and are also spaced relatively widely so as to reduce the likelihood of adhesive squeezing into the holes 104.

Figure 8:
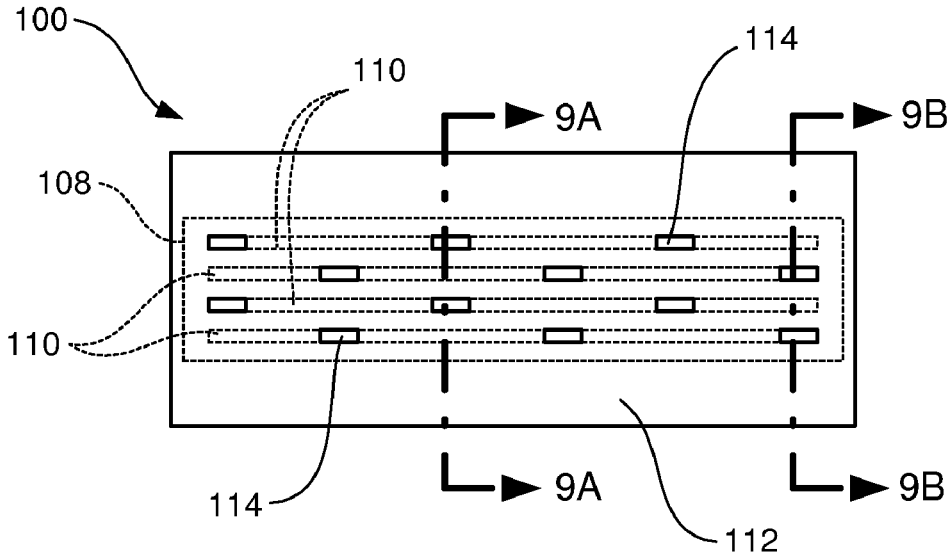
FIG. 8 is a reflected plan view of the bottom surface of the silicon interposer of FIG. 7, showing the smaller bottom openings designed to align and communicate with the fluid channels of the fluid jet die.

In the embodiment of FIGS. 7-9 the etched holes 104 have a tapered configuration, tapering in both size and position from the top surface 106 to the bottom surface 112 of the interposer 100. A reflected plan view of the bottom surface of the interposer is shown in FIG. 8. The bottom surface includes bottom openings 114 that are smaller in size than the top openings 102, and align with the elongate fluid passageways 110 of the fluid jet die 108 (shown in dashed lines). Because of the geometry of the etched holes, a portion of the bottom opening in each of the inboard holes are visible in the top surface view of FIG. 7.

Figure 9A:
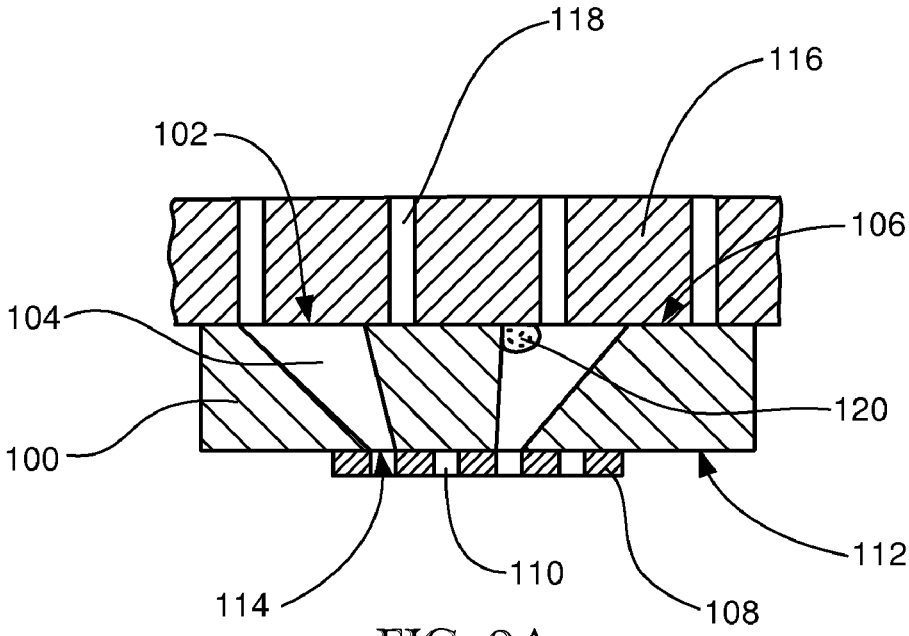
FIGS. 9A-B are cross-sectional views of the silicon interposer of FIGS. 7 and 8, attached to the fluid jet die and cartridge body.
Figure 9B:
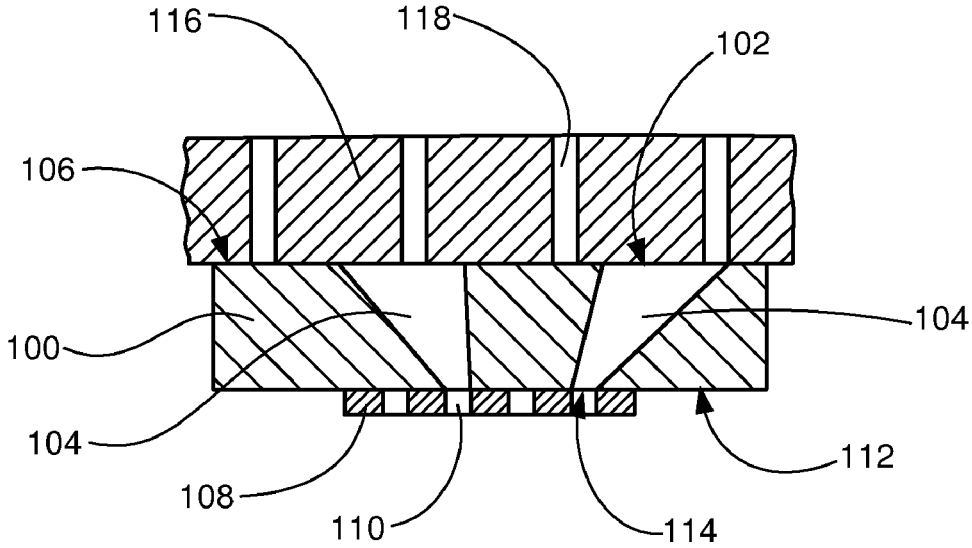

Two cross-sectional views of the interposer 100 connected between a cartridge body 116 and the fluid jet die 108 are provided in FIGS. 9A and 9B. The cartridge body includes relatively widely spaced fluid passageways 118, as discussed above. The passageways in the cartridge body can be elongate slots or channels as discussed above, or they can have other shapes, such as holes, etc. The top openings 102 of the etched holes 104 align with the cartridge body fluid passageways, and taper toward the bottom surface 112 of the interposer to the smaller bottom openings 114 that align with the fluid passageways 110 of the fluid jet die 108. As discussed above, the change in fluid passageway pitch that can be provided is a function of the thickness of the interposer and the angle of the fluid passageways therein.

The top openings 102 of the interposer 100 can be a different size and shape than the fluid passageways 118 of the cartridge body 116 and still align. For example, in the embodiment of FIGS. 7-9, the top openings are larger in at least one dimension than the fluid openings of the cartridge body. As shown in FIGS. 9A and 9B, the taper of the etched holes 104 provides a relatively large opening in the top surface of the interposer. This large size assists in the alignment of the interposer with the cartridge body, providing a greater tolerance for slight misalignment between the interposer and the cartridge body during manufacture. Additionally, while the top holes 102 of the interposer 100 are shown in alignment with elongate slots 118 of the cartridge body 116, the cartridge body could alternatively be provided with discrete holes that substantially align with the top holes of the interposer. The converse is also possible: the cartridge body can include discrete holes that align with elongate slots in the interposer.

The larger size of the top openings 102 is partly due to another feature of this embodiment. While four elongate parallel slots 110 are positioned side-by-side in the die 108, the interposer 100 does not have four etched holes 104 side-by-side, but instead provides alternating hole positions as shown in FIG. 7. That is, two side-by-side holes 104 connect with the first and third fluid slots in both the cartridge body and the die, as shown in FIG. 9A, and a subsequent two side-by-side holes 104 connect with the second and fourth fluid slots of the cartridge body and the die, as shown in FIG. 9B. This alternating configuration allows a relatively large lateral spacing between adjacent top openings 102, which reduces adhesive squeezing issues and also contributes to greater strength of the interposer.

The alternating hole configuration shown in FIG. 7 also allows the top openings 102 to be larger than otherwise, and this larger size contributes to reducing the potential negative effect of adhesive squeezing, should it occur. Viewing FIG. 9A, if a small glob of adhesive 120 is squeezed into one of the holes 104 at the interface between the interposer 100 and the cartridge body 116, the relatively large size of the top opening can make it such that the adhesive glob does not interfere with fluid flow between the cartridge body and the die.

The use of a silicon interposer also helps compensate for possible fragility of the fluid jet die. One approach that is sometimes used to reduce fabrication costs for fluid jet dies and other semiconductor devices is wafer thinning. Wafer thinning typically involves a primary mechanical polishing step and a secondary chemical polishing component that polish or grind a semiconductor wafer to reduce its thickness. Wafer thinning of a fluid jet die wafer can significantly reduce fabrication costs by reducing the energy and time required for laser etching, for example, and can reduce heat losses. However, the reduced thickness of the wafer can also make the die more fragile and subject to damage during assembly of the cartridge. By bonding the silicon fluid jet die to the relatively thick silicon interposer, its mechanical strength is greatly increased, and the likelihood of cracking of the die is greatly reduced.

Figure 17:
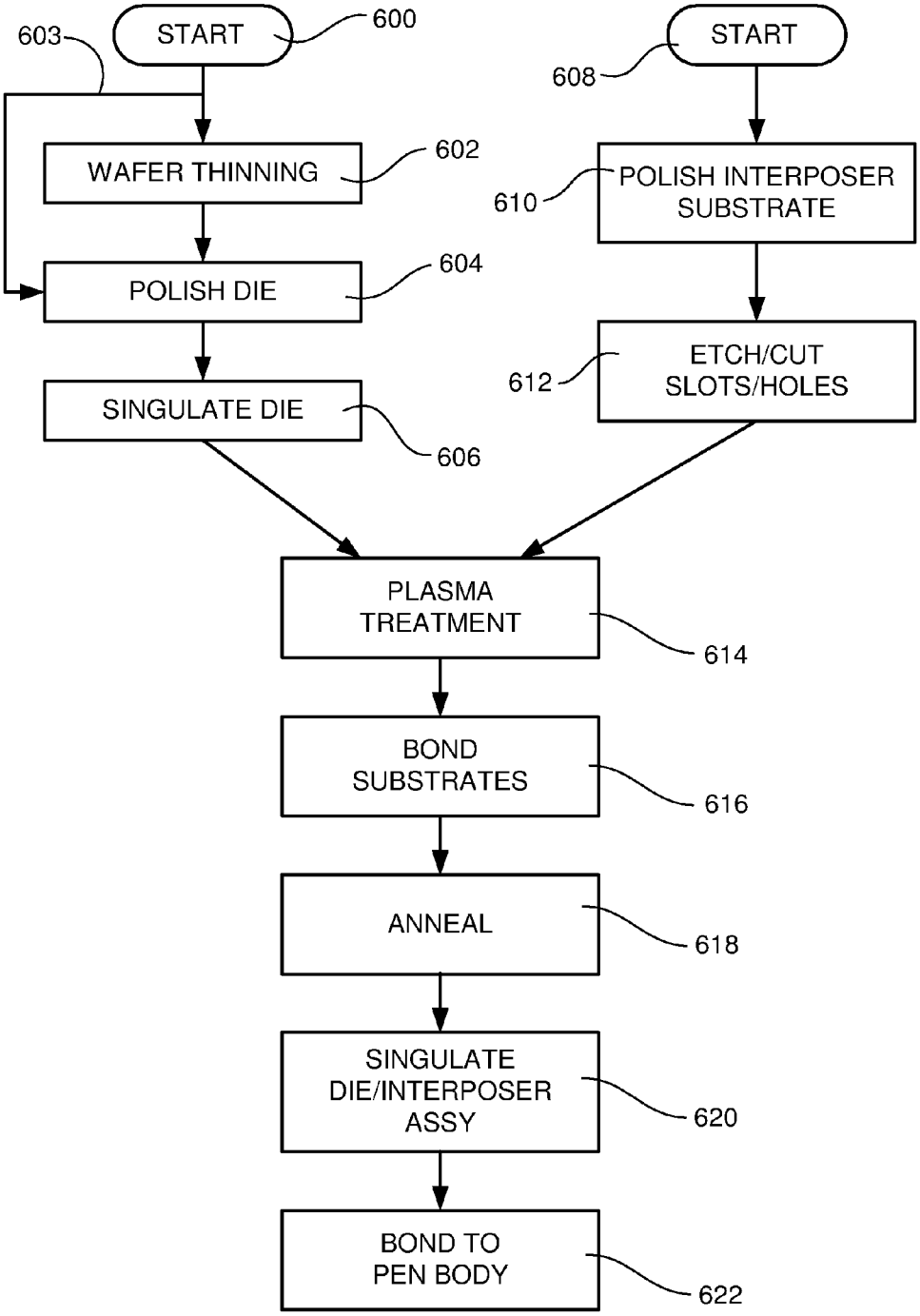
FIG. 17 is a process flow chart outlining the steps involved in one embodiment of a method for manufacturing a fluid jet cartridge with a silicon interposer.

The process steps in one embodiment of a method for fabricating a fluid jet cartridge with a plasma bonded silicon interposer in accordance with the present disclosure is outlined in FIG. 17. This process starts with two separate subprocesses, one for the fluid jet die (beginning at step 600) and another for the interposer (starting at step 608). Referring first to the steps related to the fluid jet die, the fluid jet wafer can first be thinned by back-grinding (step 602), then chemically-mechanically polished (CMP, step 604) on the side that will be bonded to the interposer, as discussed above. Alternatively, as indicated by arrow 603, the process can move straight to chemical-mechanical polishing, without wafer thinning. The chemical-mechanical polishing step is intended to provide a high level of surface smoothness (e.g. root mean square (RMS) roughness of about 0.4 nm). The fluid jet wafer can then be cleaned. There are a variety of cleaning steps that are included in the method, though for the sake of brevity these steps are not shown in the diagram of FIG. 17. Those of skill in the art will recognize those points in the process at which cleaning of the fluid jet die or interposer substrate is desirable. The fluid jet die is then singulated (i.e. sawn from a silicon wafer containing multiple dies that have been fabricated together, step 606) and then cleaned at the die level to remove any particles or contaminants.

Referring to step 608, the front side of the silicon interposer wafer is also chemically-mechanically polished (step 610), and this wafer is then laser trenched (or etched) (step 612) to prepare an array of multiple interposer structures with slots or holes as discussed above, and then cleaned at the wafer level.

The surfaces of the fluid jet die and the silicon interposer wafer that are to be plasma bonded are then treated with a high energy plasma (step 614) (e.g. a three-step plasma treatment with $N_2/H_2O/O_2$ plasma, as described above). The activated surfaces are then carefully aligned with each other and brought in contact in a bonder (step 616) with a force applied over a certain amount of time. For example, for an 8 inch diameter wafer, a force of 2000 N applied for 5 minutes has been used. This step produces a relatively large silicon interposer wafer having multiple interposer regions to which individual fluid jet dies are bonded. The bonded die-interposer assembly is then placed in an annealing oven, where it is annealed (step 618) at an elevated temperature for a certain length of time, as discussed above.

Handling of a long and narrow die does pose some potential risk of damage during manufacturing. However, this can be managed in the factory during saw, pick and place operations. Additionally, the silicon interposer configuration disclosed herein also provides several benefits. With a plasma bonded silicon-to-silicon interface between the interposer and the die, both materials will have essentially the same thermal properties. Consequently, potential stresses due to adhesive cure and mismatches in the respective coefficients of thermal expansion are avoided.

Following annealing, the silicon interposer wafer can then be singulated (i.e. sawn into multiple individual interposer/die assemblies, step 620), and cleaned again to remove any particles or other contaminants. Following this process the individual interposer/die assemblies are ready to be attached to the cartridge body (step 622), such as with an organic adhesive.

Figure 10:
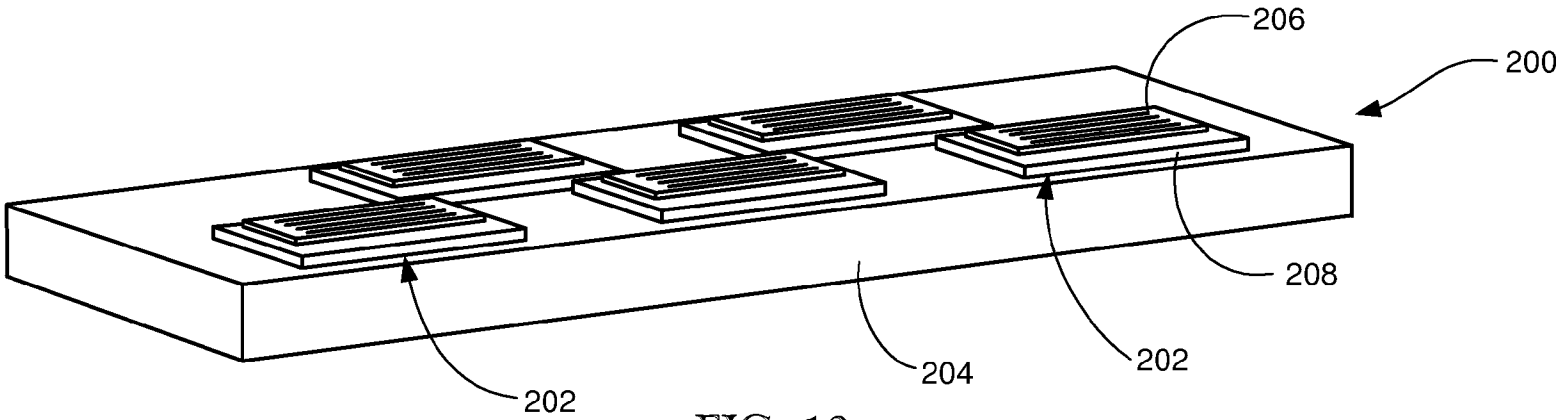
FIG. 10 is a perspective view of another embodiment of a page-wide array fluid jet cartridge having a plurality of fluid jet dies, each die being attached to a unique silicon interposer.

Individual interposer/die assemblies can be attached to cartridge bodies having various configurations. For example, shown in FIG. 10 is a perspective view looking at the bottom of one embodiment of a page-wide array fluid jet cartridge 200 having a plurality of fluid jet die/interposer assemblies 202 each attached individually to a single cartridge body 204. In this embodiment for a page-wide array, each fluid jet die 206 is plasma bonded to a separate silicon interposer 208 in the manner discussed above, and the interposer/die assemblies 202 are then adhesively bonded to the plastic print bar. The use of the silicon interposer allows significant shrinkage of the die, which can be beneficial for a page-wide array print bar. Each silicon interposer can have micro-machined alignment marks on the front side onto which the functional die can be placed and bonded, thereby forming a true page-wide array structure.

Page-wide array print bars like the one shown in FIG. 10 can be used for one-pass or multi-pass printing. The number of fluid jet dies that are attached to a single print bar can vary depending in part upon the width of the print bar and the size of the individual dies. For example, some page-wide arrays include 7 to 11 dies, with a substantial die-to-die overlap in order to avoid any die edge printing artifacts.

Figure 12:
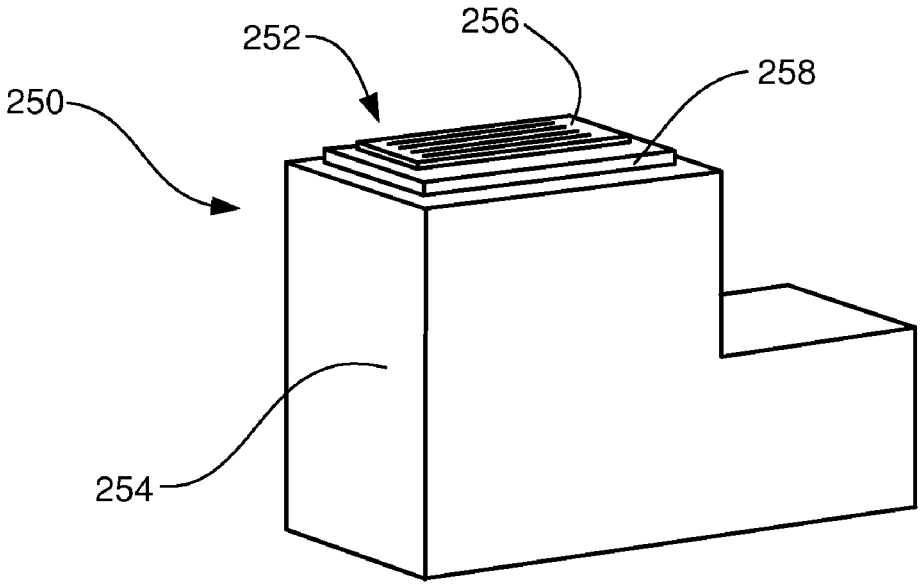
FIG. 12 is a perspective view of an embodiment of a scanning type fluid jet cartridge having a silicon interposer attached between the fluid jet die and the cartridge body.

In another embodiment, one or more interposer/die assemblies can be attached to a cartridge body of a scanning type fluid jet cartridge. For example, shown in FIG. 12 is a perspective view of a scanning type fluid jet cartridge 250 having a single interposer/die assembly 252 attached (e.g. adhesively bonded) to the cartridge body 254. In this embodiment, the fluid jet die 256 is plasma bonded to the silicon interposer 258 in the manner discussed above, and the opposite surface of the interposer is then adhesively bonded to the plastic cartridge body. As with the page-wide array embodiment of FIG. 10, this embodiment enables significant die shrink, improves thermal performance and makes the die less fragile, which is advantageous during manufacture.

Figure 11:
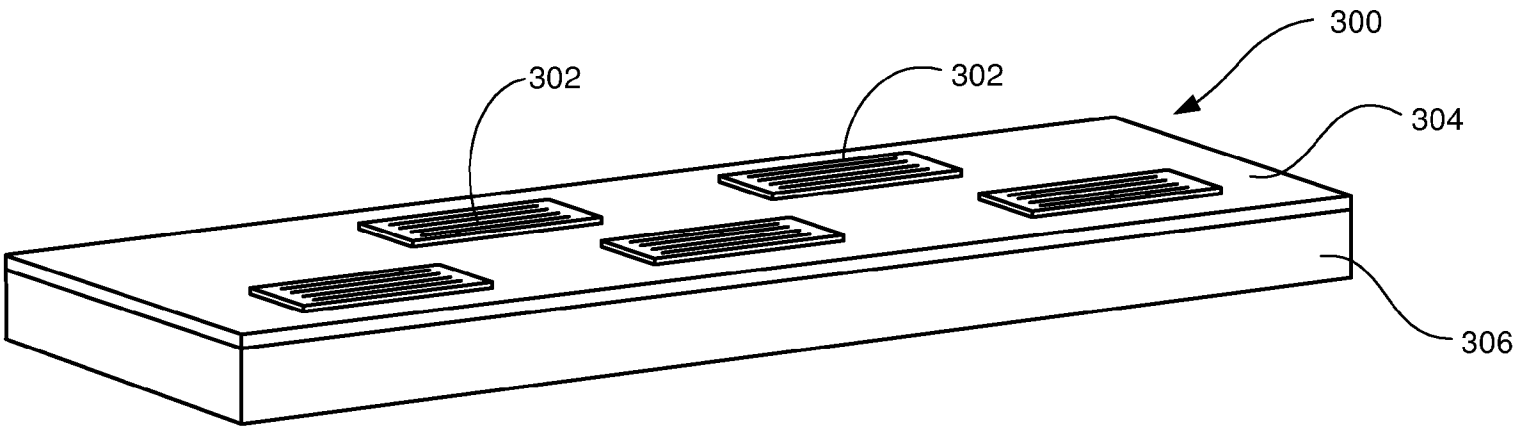
FIG. 11 is a perspective view of one embodiment of a page-wide array fluid jet cartridge having a plurality of fluid jet dies, with all dies being attached to a common silicon interposer.

Rather than attaching multiple separate interposer/die assemblies to a single cartridge body, other configurations are also possible. For example, shown in FIG. 11 is a perspective view looking at the bottom of a page-wide array fluid jet cartridge 300 having a plurality of fluid jet dies 302 that are all attached to a common silicon interposer 304. The interposer/die assembly in this case can be fabricated in a manner similar to that outlined above, except that the locations of slots or trenches in the interposer wafer is modified to correspond to the desired die placement in the finished cartridge, and individual interposer/die assemblies are not separated from each other.

In the embodiment of FIG. 11 the interposer 304 can make up the entire print bar. Thus, the entire print bar can made out of silicon (a lower, non-electronic grade silicon, as discussed above), with multiple fluid jet dies 302 plasma bonded directly to the silicon interposer (which serves as the print bar). The print bar can be adhesively bonded to a fluid delivery system 306, which can be of a plastic material.

The silicon interposer design disclosed herein provides some additional features. With a relatively thick silicon interposer, the overall thermal mass of the die will increase. This allows more transient time for heat to develop and dissipate, and therefore results in lower temperatures in the cartridge. While cartridge temperatures depend upon the characteristics of each print job, better heat dissipation is generally desirable. Increasing the thermal mass of silicon will lower the peak die temperature for similar print duty cycles.

Figure 16:
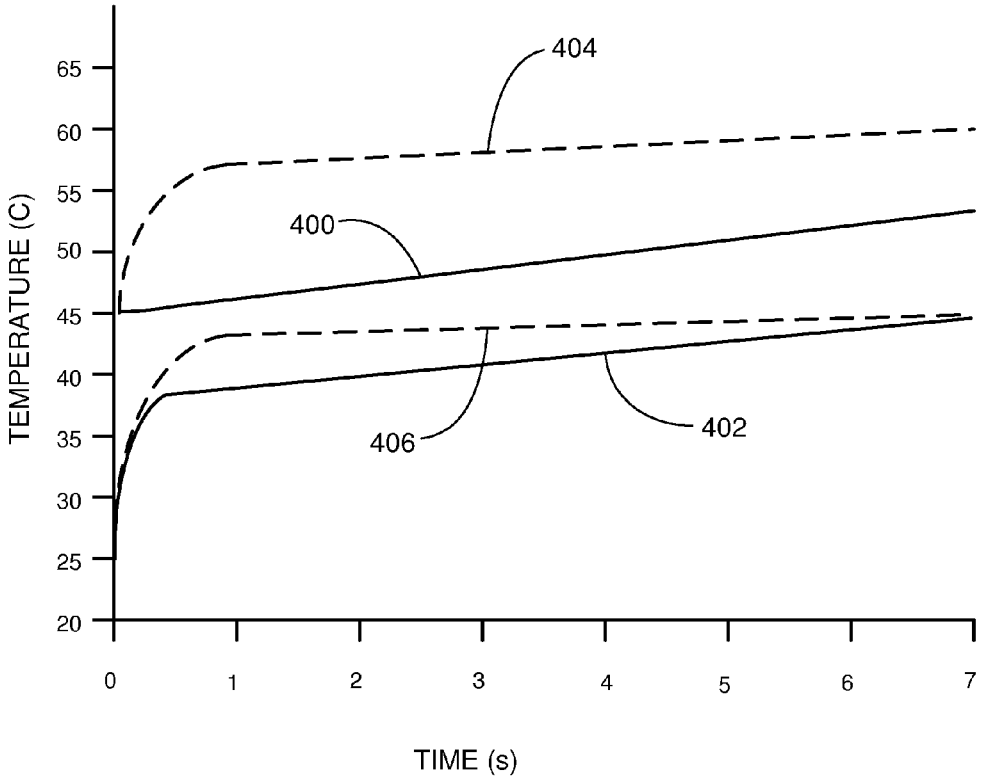
FIG. 16 is a graph comparing temperature change over time for a fluid jet cartridge assembly having a silicon interposer, and an fluid jet cartridge assembly in which the die is adhesively bonded to a plastic interposer.

Thermal modeling studies show that the average temperature of the fluid jet die and the fluid itself is significantly lower when the silicon die is bonded to a silicon interposer, rather than to a plastic substrate. Shown in FIG. 16 is a graph based upon these studies, comparing temperature change over time for the fluid jet die (line 400) and the fluid (line 402) in a fluid jet cartridge assembly in having a silicon interposer bonded to the fluid jet die, in comparison with the temperature of the fluid jet die (line 404) and fluid (line 406) in a fluid jet cartridge assembly in which the silicon die is adhesively bonded to a plastic interposer. As this graph shows, the average temperature of the fluid jet die and the fluid itself is lower by about 5-7° C. where the silicon die is bonded to a silicon interposer, compared to the silicon die bonded to the plastic interposer. Additionally, the silicon-to-silicon attachment does not produce a mismatch in the coefficient of thermal expansion between the die and the interposer, which avoids potential thermally induced stresses, and thus further enables a dramatic shrinkage of the die.

The graph of FIG. 16 shows relatively short term temperature changes. Those of skill in the art will recognize that the duration and duty cycle of print jobs can vary widely. As can be appreciated by viewing the graph of FIG. 16, the thermal benefits of the silicon interposer can diminish after a few seconds. However, for transient or short term printing jobs this benefit is significant, and since fluid jet printing systems frequently experience time breaks between jobs, the transient situation will be experienced frequently. Additionally, the inventors have found that even in steady-state operation, the temperature of a fluid jet die bonded to a silicon interposer will tend to be lower than the same die bonded directly to the plastic cartridge body.

The design of the silicon interposer can also be configured to help reduce light area banding, which is particularly notable in ink jet printing, but can also be of concern in other fluid jet applications. Light area banding is a thermally related printing defect that is caused by the ends of fluid slots in the die running cooler than the central portions of these slots. This can be a consequence of an asymmetric boundary condition in a silicon slot. As the die prints a swath it reaches a steady state temperature. However, at the ends of the slots there can be a thermal gradient established in which the slot ends are cooler. Where the ends of the slots are cooler than the center region, the fluid drop ejection behavior will be different. This results in an area or band at the die ends that is perceived by the human eye as being lighter. This defect is most visible when two slots are printed right next to each other. Light area banding can be hidden with die overlap of a certain number of nozzles. However, this approach adds to cost and complexity in manufacturing and writing systems, respectively. Light area banding is of particular concern in one-pass printing with a page-wide array, since there is no compensation for lighter areas with multiple passes of a cartridge.

Figure 13:
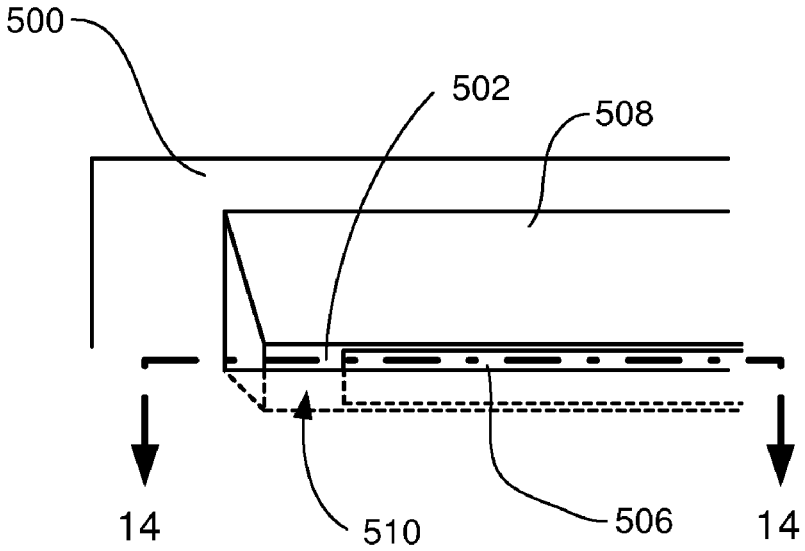
FIG. 13 is a plan view looking down upon an embodiment of a silicon interposer with a fluid jet die attached therebelow, the interposer having a fluid channel that overruns the end of the fluid jet die channel.
Figure 14:
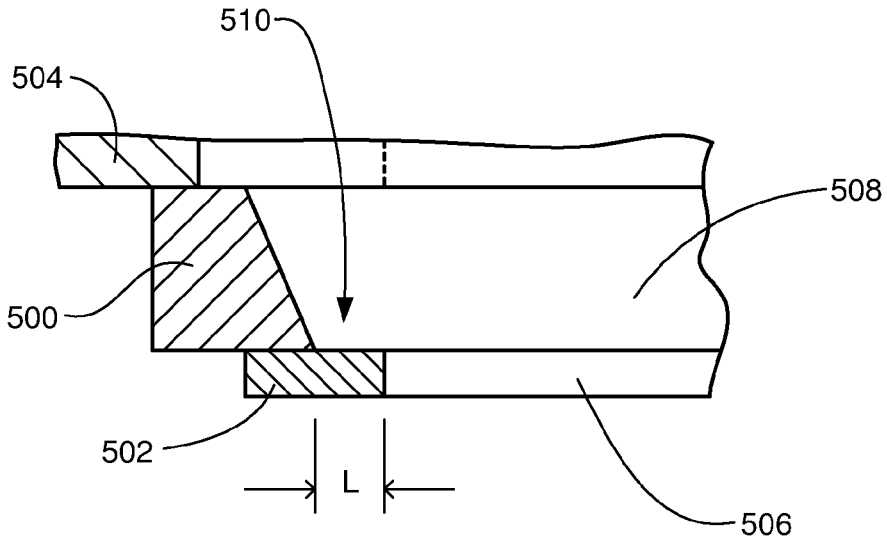
FIG. 14 is a cross-sectional view of the silicon interposer and fluid jet die of FIG. 13, showing the overrunning fluid channel.
Figure 15:
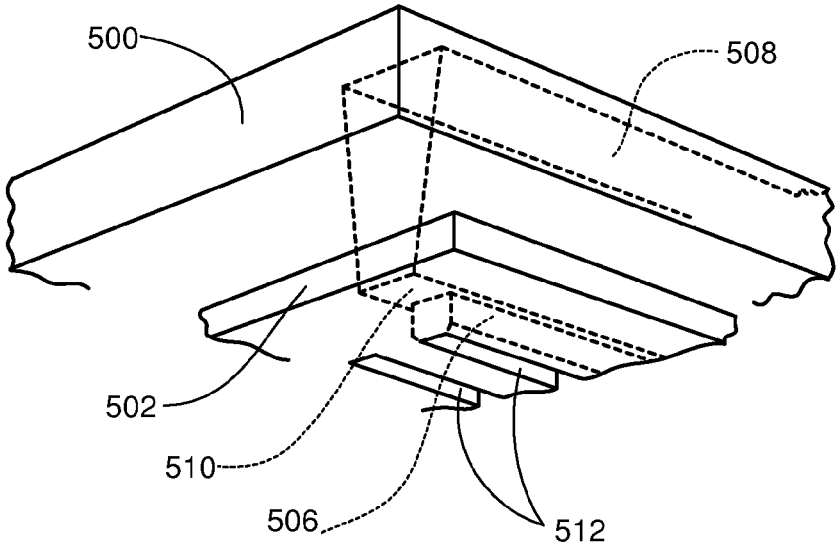
FIG. 15 is an inverted perspective view showing the geometric relationship between the interposer fluid channel volume and the fluid jet die fluid channel volume in the embodiment of FIG. 13.

The inventors have found that the design of the silicon interposer can help reduce light area banding by creating a more uniform thermal profile along the long axis of the die. The silicon interposer can be designed and micro machined to compensate for the anisotropy in the die design and reduce the heat sinking effect at the edges. Specifically, the fluid slots in the interposer can be longitudinally extended well beyond the ends of the slot of the fluid jet die, thereby pushing the thermal gradient further out. Provided in FIG. 13 is a plan view looking down upon an embodiment of a silicon interposer 500 with a fluid jet die 502 attached therebelow. A longitudinal cross-sectional view of the interposer and die attached to a cartridge body 504 is provided in FIG. 14, and an inverted perspective view showing the geometric relationship between the interposer fluid channel volume and the fluid jet die fluid channel volume is shown in FIG. 15.

The fluid jet die 502 includes elongate channels 506. To compensate for anisotropy in the die design and reduce the heat sinking effect at the ends of the die channels 506, the interposer includes a fluid channel 508 that overruns the end of the fluid jet die channel. That is, the interposer fluid channel 508 includes an overrun region 510 at its end, which allows fluid to overlie an end portion of the die 502. This extended fluid slot in the silicon interposer helps provide a more even temperature distribution along the firing nozzles 512 of the die, which helps reduce the intensity of light area banding. Since ink and other fluids can be less thermally conductive than silicon, more heat will be retained by the fluid in the functional silicon slot ends since more fluid is in contact with the back side of the die. Consequently, the drop weight at the die ends will be closer to the drop weight at the center of the die, thereby reducing the light area banding effect. The length L of the overrun region (depicted in FIG. 14) that is needed to provide the desired thermal function can vary, and can be determined by experimentation and/or thermal modeling.

With this configuration the temperature distribution along the swath height will become more even, which will produce lower light area banding intensity. Reduction of light area banding can help contribute to in-line die designs with bond pads on the long edge of the die to form a page-wide array. Additionally, a lower overall silicon die temperature (as discussed above with respect to FIG. 16) should also have a noticeable effect on light area banding, because where the overall temperature is reduced, any temperature gradient along the fluid slot will also be less extreme.

While the description provided above is presented in terms of a silicon interposer bonded to a silicon die, it is to be understood that other materials can be used for the die and interposer, and plasma bonded as discussed above. For example, fluid jet die substrates can be of silicon, glass or other materials. Likewise, the interposer can be of glass or silicon, and can be effectively plasma bonded to a glass or silicon die. While the adhesion of silicon to glass using the plasma bonding technique disclosed herein is likely to be weaker than a silicon-silicon bond, this approach is still suitable. Additionally, the interposer can be of other materials besides silicon or glass. For example, an interposer can be fabricated of ceramic material, with a layer of silicon or silicon oxide deposited on its surface. This surface can then be plasma bonded to a silicon or glass die as discussed above.

It should also be understood that while the above discussion mentions printing, printing is only one application of the fluid ejection system disclosed herein. As noted above, a variety of fluids, such as ink, food products, chemicals, pharmaceutical compounds, fuels, etc. can be applied to various types of substrates using a fluid ejection system as disclosed herein, whether for providing visible indicia, as is the case for printing, or for other non-printing uses.

The disclosure thus provides a long and narrow fluid jet cartridge die that is attached to the cartridge body with a silicon interposer disposed between the cartridge body (e.g. of polymer or other material) and the cartridge die (e.g. of silicon). The silicon interposer is plasma bonded to the silicon die and includes fanned out channels that allow a die with very small channel spacing to be attached to a cartridge body with wider spacing. The plasma bonding avoids the possibility of adhesive squeezing into fluid channels where the channel pitch is small. The geometry of the channels in the interposer can also be manipulated to help reduce thermal gradients in the fluid jet die. The approach of plasma bonding a silicon interposer to a fluid jet die can help to enable shrinkage of the die, reduce die fragility issues, improve thermal performance, help reduce light area banding, and can allow significant production cost savings for fluid jet cartridges, particularly for page-wide arrays that include multiple dies on a single print body.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A fluid ejection cartridge, comprising:

a body, having fluid passageways at a first spacing;

a die, having fluid passageways at a second closer spacing; and an interposer, bonded to the body at a first surface and plasma bonded to the die at a second surface, having fluid passageways between the first and second surfaces, the passageways being substantially aligned with the respective passageways of the body and the die.

2. A cartridge in accordance with claim 1, wherein the first spacing is greater than or equal to about 1000 microns, and the second spacing is in the range of about 400 microns to about 1000 microns.

3. A cartridge in accordance with claim 1, wherein the interposer has a thickness in a range of from about 500 microns to about 2000 microns.

4. A cartridge in accordance with claim 1, wherein the interposer is adhesively bonded to the cartridge body.

5. A cartridge in accordance with claim 1, wherein the fluid passageways of the interposer are selected from the group consisting of elongate channels and holes.

6. A cartridge in accordance with claim 1, wherein the fluid passageways of the interposer comprise elongate channels having an angled orientation extending between the first spacing and the second spacing.

7. A cartridge in accordance with claim 1, wherein the fluid passageways of the interposer comprise elongate channels having ends, each channel substantially positionally corresponding to an elongate row of nozzles in the die, each channel further comprising an overrun region at each end, extending past an end of the respective nozzle row, whereby fluid in the channel is positioned to overlie an end portion of the die beyond the end of the nozzle row.

8. A cartridge in accordance with claim 1, wherein the fluid passageways of the interposer comprise angled holes that extend between the first spacing and the second spacing.

9. A cartridge in accordance with claim 8, wherein the angled holes have a first larger opening at the first surface and a second smaller opening at the second surface, and a cross-sectional size that generally tapers therebetween.

10. A cartridge in accordance with claim 1, wherein the die is of a material selected from the group consisting of silicon and glass, and the interposer is of a material selected from the group consisting of silicon, glass, and silicon-coated ceramic.

11. A method of making a fluid ejection cartridge, comprising the steps of:

fabricating fluid passageways between first and second surfaces of an interposer, the fluid passageways having a first spacing at the first surface and a second closer spacing at the second surface;

plasma bonding the second surface of the interposer to a top surface of a die having fluid passageways substantially at the second closer spacing; and attaching the first surface of the interposer to a cartridge body.

12. A method in accordance with claim 11, wherein the step of plasma bonding the interposer to the die further comprises:

exposing the second surface of the interposer and the top surface of the die to a plasma to activate bonding sites on the surfaces;

pressing the second surface of the interposer and the top surface of the die together; and annealing the attached die and interposer to strengthen the bond therebetween.

13. A method in accordance with claim 12, wherein the interposer and die are of silicon material, and wherein the step of exposing the second surface of the interposer and the top surface of the die to a plasma further comprises:

exposing the second surface and top surface to a nitrogen plasma to activate Si+ bonding sites on the silicon surfaces;

exposing the second surface and the top surface to a water plasma to produce SiOH species on the silicon surfaces; and exposing the second surface and the top surface to an oxygen plasma to clean the silicon surfaces.

14. A method in accordance with claim 12, wherein the step of annealing the attached die and interposer comprises heating the attached die and interposer to about 120° C. for about 2 hours.

15. A method in accordance with claim 11, wherein the step of fabricating the fluid passageways comprises cutting elongate channels having ends, each channel substantially positionally corresponding to an elongate row of nozzles in the die, each channel further comprising an overrun region at each end, extending past an end of the respective nozzle row, whereby fluid in the channel is positioned to overlie an end portion of the die beyond the end of the nozzle row.

16. A method for ejecting a fluid, comprising the steps of:

directing the fluid through cartridge passageways at a first spacing into substantially aligned openings of an interposer;

directing the fluid through interposer passageways to outlets at a second closer spacing at a second surface of the interposer, the second surface being plasma bonded to a top surface of a fluid ejection die having openings substantially at the second closer spacing; and ejecting the fluid from the fluid ejection die.

17. A method in accordance with claim 16, wherein the step of directing the fluid through cartridge passageways comprises directing the fluid through cartridge passageways at a first spacing that is greater than or equal to about 1000 microns, and the step of directing the fluid through interposer passageways comprises directing the fluid through interposer passageways to outlets at a second closer spacing in the range of about 400 microns to about 1000 microns.

18. A method in accordance with claim 16, wherein the step of directing the fluid through interposer passageways comprises directing the fluid through elongate channels that angularly extend between the first spacing and the second spacing.

19. A method in accordance with claim 16, wherein the step of directing the fluid through interposer passageways comprises directing the fluid through angled holes that extend between the first spacing and the second spacing.

20. A method in accordance with claim 16, wherein the step of directing the fluid through interposer passageways comprises directing the fluid into elongate channels having an overrun region at opposing ends, the overrun regions overlying an end portion of the die beyond an end of a nozzle row of the die.

* * * * *

UNITED STATES PATENT AND TRADEMARK OFFICE

CERTIFICATE OF CORRECTION

PATENT NO. : 8,240,828 B2
APPLICATION NO. : 12/747629
DATED : August 14, 2012
INVENTOR(S) : Alok Sharan et al.

It is certified that error appears in the above-identified patent and that said Letters Patent is hereby corrected as shown below:

On the title page, item (75), Inventors, in column 1, line 2, delete "Manishi" and insert -- Manish --, therefor.

Signed and Sealed this
Fifteenth Day of January, 2013

David J. Kappos

David J. Kappos
*Director of the United States Patent and Trademark Office*